US005633045A

United States Patent [19]

Smith et al.

[11] Patent Number: 5,633,045

[45] Date of Patent: May 27, 1997

[54] APPARATUS AND PROCESS FOR COATING WEBS USING A CYLINDRICAL APPLICATOR

[75] Inventors: Warren R. Smith, Webster; Gary W. Smallman, Fairport; Kenneth A. Donahue, Webster, all of N.Y.; Mark Muscato, Yukon, Okla.

[73] Assignee: Xerox Corporation, Stamford, Conn.

[21] Appl. No.: 521,897

[22] Filed: Aug. 31, 1995

[51] Int. Cl.[6] ..... B05D 1/28; B05C 1/08

[52] U.S. Cl. ..... 427/428; 118/244; 118/249; 118/250; 118/261

[58] Field of Search ..... 118/249, 250, 118/261, 244; 427/428

[56] References Cited

U.S. PATENT DOCUMENTS

| | | | |
|---|---|---|---|
| 3,294,060 | 12/1966 | McIntyre et al. | 118/261 |
| 3,315,636 | 4/1967 | Lester et al. | 118/261 |
| 3,492,840 | 2/1970 | Korsch | 68/202 |
| 3,552,292 | 1/1971 | Gold | 95/89 |
| 3,722,453 | 3/1973 | Dahlquist et al. | 118/249 |
| 3,863,600 | 2/1975 | Van Regenmortel | 118/419 |
| 3,936,549 | 2/1976 | Kohler et al. | 427/428 |
| 4,503,802 | 3/1985 | Keller et al. | 118/249 |
| 4,615,295 | 10/1986 | Wittkopf | 118/249 |
| 4,738,879 | 4/1988 | Williams | 427/428 |
| 5,330,575 | 7/1994 | Poole et al. | 118/261 |

*Primary Examiner*—Katherine A. Bareford

[57] ABSTRACT

A coating system is disclosed comprising apparatus for coating webs comprising a rigid, elongated trough, a cylindrical applicator mounted for rotation about its axis within the trough, the trough having an arcuate upstream liquid retaining surface and an arcuate downstream liquid retaining surface closely spaced from the lower surface of the cylindrical applicator to define an arcuate coating zone which progressively narrows in the downstream direction, a manifold between the upstream liquid retaining surface and the downstream liquid retaining surface, the manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of any liquid in the coating zone, a wall at each end of the trough to retain the liquid in the coating zone, each of the walls being closely spaced from the adjacent end of the cylindrical applicator, and means for continuously introducing liquid into the manifold. A process for using this type of apparatus for coating webs is also disclosed.

18 Claims, 1 Drawing Sheet

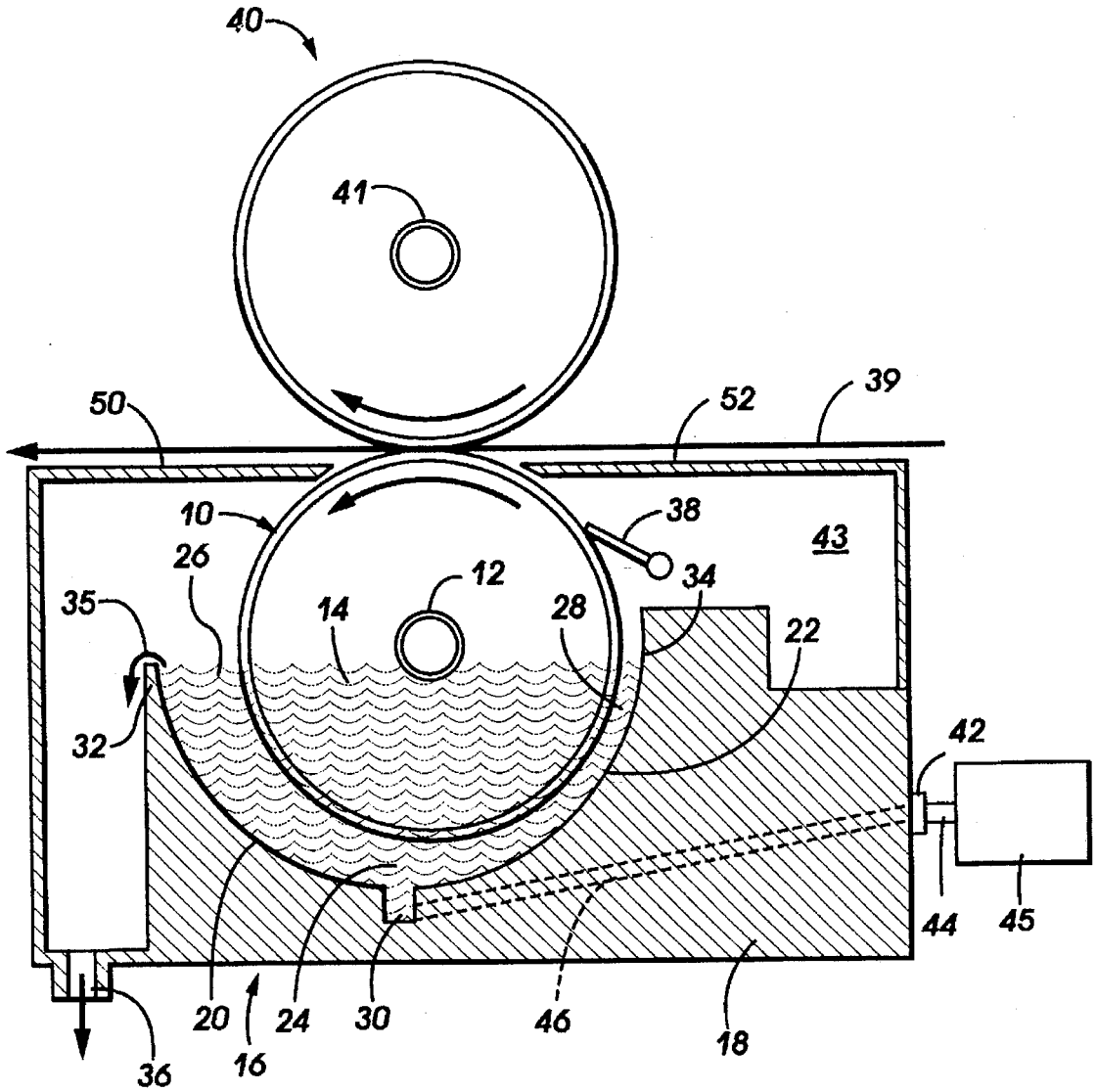
40
41
50
52
39
10
38
43
26
12
34
35
14
28
22
32
42
44
45
20
24
30
46
18
36
16

APPARATUS AND PROCESS FOR COATING WEBS USING A CYLINDRICAL APPLICATOR

BACKGROUND OF THE INVENTION

This invention relates to a coating device and process, and in particular, to an improved system comprising a trough and a cylindrical applicator for applying fluid to a moving web.

Devices for applying fluids to a moving web are well known. For example, roll coating is one of the common techniques for continuously applying a liquid film onto a moving sheet. Roll coating apparatus often utilize gravure applicators to apply a very thin coating to a moving web. These gravure applicators are generally cylindrical and have an etched surface. These etched surfaces comprise valleys or cells which are filled with an unmetered quantity of the coating material applied from an adjacent roller or by rotating the gravure applicator in a bath of the coating material. A doctoring or wiper blade may be employed to regulate the amount of solution in the cells on the surface of the gravure applicator. As the cylinder rotates, the wiper or doctor blade removes all the excess coating from the surface leaving a measured amount of liquid in the recessed areas or cells. Approximately half of this measured amount of liquid in the recessed are as or cells is then transferred from the cells to a moving web by means of hydro-dynamic forces of a fluid having appropriate rheological characteristics such as fluid/solid and fluid/air surface tensions. These rheological characteristics are synchronized with variables such as applicator roll diameter, web surface speed and viscosity of the coating fluid being applied.

INFORMATION DISCLOSURE STATEMENT

In U.S. Pat. No. 4,738,879 issued to Williams on Apr. 19, 1995, a coating system is disclosed comprising apparatus for coating webs comprising a rigid, elongated trough, a cylindrical applicator mounted for rotation about its axis within the trough, the trough having an arcuate upstream liquid retaining surface and an arcuate downstream liquid retaining surface substantially parallel to and closely spaced from the lower surface of the cylindrical applicator to define an arcuate coating zone, a manifold between the upstream liquid retaining surface and the downstream liquid retaining surface, the manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of any liquid in the coating zone, a wall at each end of the trough to retain the liquid in the coating zone, each of the walls being closely spaced from the adjacent end of the cylindrical applicator, an arcuate drain channel adjacent to at least one of the walls to collect overflow liquid from the downstream liquid retaining zone and return the overflow liquid back by gravity to the manifold, and means for continuously introducing liquid into the manifold. A process for using this type of apparatus for coating webs is also disclosed.

In U.S. Pat. No. 3,863,600 issued to Van Regenortel on Feb. 4, 1975, new coating pan is described which renders the regulation of the coating width very easy. The characteristic features of the coating pan are the uniform distribution of the liquid to be coated over the whole width of the pan and the provision of movable end dikes which are so designed that the liquid may flow over and under the dikes. By means of a screw type regulating device, the dams may be moved over a part of the coating width, without creating stagnant zones in the pan.

In U.S. Pat. No. 3,936,549 issued to Kohler et al on Feb. 3, 1976, a method and apparatus for applying a liquid coating to a strip of material are disclosed. A trough-like pan holds a supply of coating liquid at a constant level maintained by continuous feeding of the coating solution into the pan and draining of the coating solution over weirs spaced inwardly from the ends of a roll partially immersed in the coating liquid. The roll may serve as a backup roll for a strip passing around it or as a transfer roll to transfer coating liquid from the pan to a strip in contact with the upper portion of the roll. The coating system does not appear to relate to the use of gravure roll coating. The coating material is not doctored on the roll and no impression roller is employed to transfer coating material to a web. The weirs are complex adjustable baffles that prevent coating material from contacting the ends of the roll. The coating material that overflows the weirs is drained out of the pan prior to recycling.

In U.S. Pat. No. 4,503,802 to Keller et al, a device is disclosed for applying fluid to moving webs in which a rotating lower roller has a bottom portion immersed in a pool of fluid contained in an open pan. The lower roller is used to transfer fluid from the trough to a second roller engaged with the first roller. The open pan employed with the 3-roller applicator is of an unspecified design. The applicator is apparently intended to apply thin or light fluid coatings to a moving fabric web. The applicator roll contains very large grooves or recesses and no post doctoring of the coating fluid is utilized to transfer solution to a moving web.

In U.S. Pat. No. 3,552,292 to Gold, a photographic processing apparatus is disclosed which employs a roll that rotates in a well in which liquid is maintained at a constant volume. Fluid absorbed by the roll as it rotates through the liquid is passed to the surface of an oppositely moving sheet material. Thus, this patent relates to a kiss coating system utilizing a non-adjustable roll with a liquid container. The coating weight thickness applied is very dependent on viscosity, roll speed and web speed. The coater system of the Gold patent is entirely enclosed and cannot be observed by the operator to determine whether the coating solution is uniformly wetting the entire roll surface.

In U.S. Pat. No. 3,492,840 to Korsch, a dyeing apparatus is disclosed in which a roller is positioned in a pan equipped with feeding and discharge means to control the level of fluid therein. When the roller is rotated through the pan, the fluid adheres to the roller and is subsequently transferred to a textile surface which contacts the roller. The closed pan employed by Korsch can be rotated to adjust the amount of solution needed for transfer by the first roll to the nip or nap side of a fabric. There is no post metering of the solution as in a gravure process. Only the amount of solution on the roller after emerging from the pan dictates the wet film thickness of the coated substrate after it leaves the applicator roll. Moreover, this process employs an overflow weir and pump for complete solution (dye) recirculation.

These coating systems provide satisfactory results for many applications. However, when open pans or troughs of coating fluid are employed to apply the coating liquid to the surface of applicator rollers, difficulties have been experienced where the viscosity and solids concentration in the coating solution must be regulated within very narrow limits to achieve precise coatings for applications such as layers in electrostatographic imaging members. The problem is particularly acute when the coating solution is applied to the cylindrical applicator by merely dipping a portion of the cylinder in a bath of the coating solution contained in the open pan or trough. The open pan or trough technique lends itself to environmental contamination of the coating material by elements in the ambient atmosphere such as lint and dirt particles. This in turns leads to undesirable variation in the dry coating thickness on the web and surface defects in the deposited coating that adversely affect coated article yields. Open troughs also promote excessive evaporation of coating solvents or carriers which can dramatically alter the concentration of coating solids and the viscosity of the coating material. Most open troughs must frequently be emptied, cleaned and filled with fresh material by hand which is time consuming, expensive and normally requires shut down of the entire coating line.

Some troughs require the use of a large volume of coating material which necessitates larger investment in material and greater waste when the material is replaced by fresh coating material after the troughs are cleaned. Further, many troughs do not recirculate the coating material that may overflow from the trough or require costly recirculating pumps and hoses which involve use of even larger quantities of coating material and are most costly to initially install, maintain, clean and repair.

Many coating systems also have limited capability for adjustments and cannot readily accommodate variations in the coating parameters such as coating material viscosity, applicator roll speed and the like. Cylindrical applicators employed for webs often exhibit various other disadvantages such as an absence of means to adjust the coating fluid trough up or down relative to a cylindrical applicator immersed in the coating material in the trough.

Generally, troughs are made out of heavy and expensive metallic materials which can often damage applicator rolls if brought into contact with the delicate outer surface of the applicator rolls. Troughs that are machined out of blocks of metal are both expensive and extremely difficult to handle because of their weight. For example, it is estimated that the trough illustrated in FIG. 1 of U.S. Pat. No. 3,552,292 weighs as much as 300 to 400 pounds for systems capable of coating a web having a width of about 44 centimeters.

Many of the problems encountered with cylindrical gravure applicators employed with pans or troughs have been overcome with a coating system comprising a cylindrical applicator mounted for rotation about its axis within a trough having an arcuate upstream liquid retaining surface and an arcuate downstream liquid retaining surface substantially parallel to and closely spaced from the lower surface of the cylindrical applicator to define an arcuate coating zone. A manifold is positioned between the upstream liquid retaining surface and the downstream liquid retaining surface. This manifold extends substantially parallel to the axis of the cylindrical applicator and the arcuate downstream liquid retaining surface. The arcuate upstream liquid retaining surface extends from the manifold upwardly a sufficient distance along the periphery of the cylindrical applicator to retain most of any liquid in the coating zone. A wall at each end of the trough retains the liquid in the coating zone and an arcuate drain channel adjacent to at least one of the walls collects overflow liquid from the downstream liquid retaining zone and returns the overflow liquid back by gravity to the manifold. Fresh liquid is continuously introduced into the manifold. This system is disclosed in U.S. Pat. No. 4,738,879, the entire disclosure thereof being incorporated herein by reference.

Gravure applicator rolls are engraved with a pattern of minute cells recessed on their outer surface. These gravure applicator rolls or cylinders are composed only of recessed cells on their outer surface and contain no solid areas. As described above, these cells are filled with a coating solution by rotating the gravure cylinder while it is partially immersed in a pan or reservoir of coating solution. The rotating gravure cylinder surface is then wiped by a blade, commonly referred to as a doctor blade, which removes excess solution or meniscus from the cells to leave a measured amount of coating in the cells for application to the substrate being coated. The coating contained within the cells is transferred to the substrate by a combination of capillary action and impression pressure which creates a vacuum in the nip area where the substrate is brought into contact with the gravure cylinder. This impression area or nip is created by a backing roller, commonly referred to as an impression roll, which is covered with a resilient rubber. The impression roll is lowered against the gravure cylinder, or, as a preferred alternative, the gravure cylinder, with its reservoir, is raised to the impression cylinder, pinching the substrate between the gravure cylinder and the impression cylinder. One problem with this method of applying coatings has been identified in the means by which the cells of the gravure cylinder are filled utilizing the pan or reservoir technique. The moving surface of the gravure cylinder carries with it a boundary layer of air. This boundary layer of air adjacent to the surface of the gravure cylinder and air contained within the cells of the gravure cylinder prevents the complete filling of the cells. This incomplete filling or cavitation at a cell or cells can cause a thin area or, in the worst case, a void in the printed pattern on the substrate. For high precision devices, such as coated electrostatographic imaging members, these undesirable defects require that they be scrapped.

The problems encountered with boundary layer of air adjacent to the surface of the gravure cylinder and with air contained within the cells problem has been addressed in the past by utilizing a pump pressurized fountain applicator which is sealed to the gravure cylinder. This system has the disadvantage of being difficult to clean and, due to its requirement of sealing to the cylinder surface, causes excessive wear on and premature wear out of the engraved cell pattern. Additionally, particulates in the solution are prone to becoming entrapped at the seal to cylinder interface, causing streaks in the applied coating and scratching the delicate engraved surface of the cylinder, rendering it useless.

Other coating systems are necessarily complex and require the use of elaborate apparatus such as three roll devices, e.g. reverse roll gravure systems.

Thus, while systems utilizing the above-described known approaches may be suitable for their intended purposes, there continues to be a need for the development of an improved coating system.

SUMMARY OF THE INVENTION

It is an object of this invention to provide a novel coating system which overcomes the above-noted disadvantages.

It is another object of this invention to provide a coating system that positively and efficiently filling the cells of a gravure cylinder without contact with the cylinder.

It is still another object of this invention to

It is another object of this invention to provide a coating system for precisely maintaining viscosity and solids concentration in coating solutions.

It is still another object of this invention to provide a coating system for reducing environmental contamination of the coating material.

It is another object of this invention to provide a coating system for minimizing excessive evaporation of coating solvents or carriers.

It is still another object of this invention to provide a coating system for reducing the frequency of emptying, cleaning and filling of coating troughs.

It is another object of this invention to provide a coating system for minimizing the amount of coating material employed in coating troughs.

It is still another object of this invention to provide an adjustable coating system which accommodates variations in the coating parameters.

It is another object of this invention to provide a coating system utilizing lighter weight and less expensive coating troughs.

It is still another object of this invention to provide a simpler coating system.

It is another object of this invention to provide a coating system for reducing or eliminating damage, particularly to the applicator cylinder, when coating system components contact each other.

The foregoing objects and others are accomplished in accordance with this invention by providing an apparatus and process for coating webs in which the apparatus comprises an elongated trough, a cylindrical applicator mounted for rotation about its axis within the trough, the rotation being in a direction from upstream to downstream the trough having an arcuate upstream liquid retaining surface and an arcuate downstream liquid retaining surface closely spaced from the lower surface of the cylindrical applicator to define an arcuate coating zone which progressively narrows in the downstream direction, a manifold between the upstream liquid retaining surface and the downstream liquid retaining surface, the manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of any liquid in the coating zone, a wall at each end of the trough to retain the liquid in the coating zone, each of the walls being closely spaced from the adjacent end of the cylindrical applicator, and means for continuously introducing liquid into the manifold.

The process for applying a coating to a moving web according to this invention comprises providing an elongated trough, rotating a cylindrical applicator about its axis in contact with coating liquid within the trough, the cylindrical applicator being below and in contact with the web to carry coating liquid from the trough and applied to the web, the trough having an arcuate upstream liquid retaining surface and an arcuate downstream liquid retaining surface closely spaced from the lower surface of the cylindrical applicator to define an arcuate coating zone which progressively narrows in the downstream direction, the arcuate upstream liquid retaining surface and the arcuate downstream liquid retaining surface being separated by a manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of the liquid in the coating zone, continuously supplying sufficient coating liquid to the arcuate coating zone whereby the coating liquid coats the entire length of the lower surface of the cylindrical applicator and overflows out of the arcuate coating zone, and continuously introducing fresh coating liquid into the manifold at a rate greater than the rate at which the coating liquid is applied to the web.

BRIEF DESCRIPTION OF THE DRAWING

Other aspects of the present invention will become apparent in view of the following description with reference to accompanying drawing:

FIG. 1 shows a schematic elevational end view depicting a coating device of the present invention.

The figure is merely a schematic illustration of the present invention. It is not intended to indicate the relative size and dimensions of components thereof.

DETAILED DESCRIPTION OF THE DRAWINGS

Inasmuch as the art of coating with cylindrical applicators is well known, the various processing stations employed in the coating system illustrated in the drawings will be described only briefly.

Referring to FIG. 1, a coating system is illustrated comprising cylindrical applicator 10 supported on a shaft 12, the ends of shaft 12 being supported in suitable bearings mounted in a suitable frame or stand and driven by a conventional drive motor (not shown). The lower section of cylindrical applicator 10 is immersed in a liquid coating material 14 contained in elongated trough 16 which is supported independently of cylindrical applicator 10. Elongated trough 16 comprises a molded plastic member 18 having arcuate upper surfaces comprising an arcuate upstream liquid retaining surface 20 and an arcuate downstream liquid retaining surface 22. The upstream liquid retaining surface 20 and the downstream liquid retaining surface 22 are spaced from the lower arcuate surface of cylindrical applicator 10 to define a coating zone 24 which progressively narrows in the downstream direction from upstream coating subzone 26 to downstream coating subzone 28. A manifold 30 between the upstream liquid retaining surface 20 and the downstream liquid retaining surface 22 extends along the length of cylindrical applicator 10. Manifold 30 is substantially parallel to shaft 12. The upstream lip 32 of upstream liquid retaining surface 20 and the downstream lip 34 of downstream liquid retaining surface 22 extend a sufficient distance upwardly from manifold 26 to retain most of any liquid in coating zone 24. Because of the pumping action resulting from rotation of cylindrical applicator 10 in a closely spaced relationship to the liquid retaining surfaces 20 and 22, downstream lip 34 must be higher than upstream lip 32. Upstream lip 32 is sufficiently high to retain most of the liquid introduced into coating zone 24, but low enough to permit a limited amount of overflow 35 of coating material. Although the overflow 35 is illustrated as overflowing over upstream lip 32, the overflow may alternatively be directed over downstream lip 34 or over both upstream lip 32 and downstream lip 34 (not shown). However, overflow 35 over the upstream lip 32 is preferred because the flow of fluid from manifold 30 toward upstream lip 32 runs contra to the flow created by the pumping action of the moving surface of cylindrical applicator 10 amplifies turbulence in the upstream coating subzone 26 thereby enhancing the scrubbing away of the air boundary layer adjacent the moving surface of cylindrical applicator 10 as well as removal of air in the cells of cylindrical applicator 10. The liquid overflow 34 over upstream lip 32 exits the coating system through drain 36 which can lead to any suitable collecting container or or other suitable disposal system (not shown). As cylindrical applicator 10 is rotated in the direction of the arrow, the layer of liquid coating material carried on the surface of cylindrical applicator 10 as it emerges from downstream coating subzone 28 is doctored by doctor knife 38. The doctored liquid coating material carried on cylindrical applicator 10 is thereafter applied to web 39. An impression roll 40 is positioned at about the 12 o'clock position of cylindrical applicator 10 to assist in transfer of the coating material from cylindrical applicator 10 to web 39. Impression roll 40 is supported on a shaft 41, the ends of shaft 41 being supported in suitable bearings mounted in a frame or stand (not shown). End walls 43 are provided at each end of elongated trough 16 adjacent the ends of cylindrical applicator 10 to confine the liquid coating material 14 in elongated trough 16. The end walls are preferably positioned as close as possible to, but out of contact with, the ends of cylindrical applicator 10 to maintain pressure in liquid coating material in the the arcuate coating zone 24. Typical end walls are also illustrated in U.S. Pat. No. 4,738,879, the entire disclosure thereof being incorporated herein by reference. An inlet fitting 42 is connected by hose 44 to a suitable conventional pump and metering means 45 to continuously feed coating material through channel 46 to manifold 30. Coating material supplied through fitting 42 is uniformly distributed along the entire lower surface of cylindrical applicator 10 by manifold 30. An overflow pan (not shown) is positioned below molded plastic member 18 to catch any overflow of coating liquid from molded plastic member 18. A typical overflow pan is illustrated in U.S. Pat. No. 4,738,879. Removable covers 50 and 52 retard evaporation of coating solvents or carriers and reduce contamination of the coating material by foreign matter from the environment. Molded plastic member 18 may be supported on any suitable support means (not shown) adapted raise and lower it such as the means illustrated in U.S. Pat. No. 4,738,879. Since cylindrical applicator 10 is supported on a frame or stand (not shown) independently of trough 16, vertical adjustment of trough 16 adjusts the vertical distance between trough 16 and cylindrical applicator 10. Typical raising and lowering means include, for example, scissor jacks, pneumatic cylinders with stops, and the like. If desired, the Impression roll 40 and/or the cylindrical applicator 10 may be raised or lowered by similar raising and lowering means. Thus, the impression roll 40 may be lowered toward the cylindrical applicator 10, or, as a preferred alternative, the cylindrical applicator 10, with trough 16, is raised to the impression roll 40, pinching the web 39 between cylindrical applicator 10 and impression roll 40. Rotation of cylindrical applicator 10 in the direction of the arrow forces the liquid coating material fluid through an arcuate coating zone which progressively narrows in the downstream direction to create a relative higher pressure high in the downstream direction sufficient to allow the liquid coating material to penetrate the air boundary on surface of cylindrical applicator 10, displace that air, and completely wet and fill the cells completely for uniform delivery to web 39.

Any suitable rigid, metallic or non-metallic material may be utilized to form the trough of this invention. Typical metallic materials include stainless steel, aluminum, chrome plated steel, nickel plated steel and the like. Typical non-metallic materials include resins such as polyethylene, polypropylene, polytetrafluoroethylene, nylon, polyurethane, and the like. If desired,combinations of metal and non-metallic materials may be utilized such as a metal trough coated with a non-metallic coating or a plastic trough coated with a metallic coating. A particularly preferred material is ultrahigh molecular weight polyethylene having a number average molecular weight between about $3.1\times10^6$ and about $5.6\times10^6$. These materials are very hard, readily machinable, and characterized by sufficient rigidity to maintain tolerances without reinforcing materials. The trough materials should not react with or dissolve in any of the components of the coating mixture such as the solvent or liquid carrier utilized. Preferably, the surface of the trough material facing the applicator roller is constructed of a material having a Rockwell "R" hardness less than that of the applicator roll such as about 64 to prevent damage to the applicator roller surface should the trough accidentally come in contact with the applicator roll during installation or adjustment. The trough may be made by any suitable technique such as machining, stamping, welding,molding, and the like. Thus, for example, metal troughs constructed from sheet metal can be formed by stamping and/or welding.

The arcuate coating zone progressively narrows in the downstream direction. The cross sectional shape of the arcuate coating zone, viewed in a direction tangent to the lower surface of the cylindrical applicator, is rectangular throughout the arcuate coating zone. The total cross sectional area of the arcuate coating zone becomes progressively smaller in the downstream direction. The dimension of the rectangular shape that diminishes in the downstream direction is the the dimension representing the radial distance or gap measured radially (along an extension of the radius of the cylindrical applicator) between the lower surface of the cylindrical applicator and the adjacent liquid retaining surface. This gap in the arcuate coating zone at the downstream end of the downstream coating subzone should be sufficient to prevent contact between the outer surface of the cylindrical applicator roll which generally is at least about 1 millimeter at about the 3 o'clock position. Also, the lip at the end of the downstream end of the downstream coating subzone should be high enough to avoid significant overflow of the coating material out of the molded plastic member due to the pumping action of the rotating cylindrical applicator roll. The arcuate upstream liquid retaining surface and arcuate downstream liquid retaining surface of the elongated trough together form a substantially semicircular shape The gap at the arcuate coating zone at the beginning of the upstream end of the upstream coating subzone at about the 9 o'clock position should be sufficient to achieve turbulence in the liquid coating material throughout substantially all of the upstream coating subzone. Preferably, turbulence is enhanced by establishing overflow of coating liquid material out of the arcuate coating zone at the beginning of the upstream coating subzone as illustrated in FIG. 1. More specifically, when overflow 35 is effected over the upstream lip 32, the more pronounced flow of fluid from manifold 30 toward upstream lip 32 runs contra to the downstream flow created by the pumping action of the moving surface of cylindrical applicator 10. This contra flow amplifies turbulence in the upstream coating subzone 26 and enhances the scrubbing away of the air boundary layer adjacent the moving surface of cylindrical applicator 10 as well as removal of air in the cells of cylindrical applicator 10. Thus, as indicated above, the cross section of the arcuate coating zone at the beginning of the upstream end of the upstream coating subzone should be greater than the cross section of the arcuate coating zone at the downstream end of the downstream coating subzone. Preferably, the radial distance or gap between arcuate upstream liquid retaining surface and the surface of the cylindrical applicator is between about 150 percent and about 500 percent greater than the radial distance or gap between arcuate downstream liquid retaining surface and the surface of the cylindrical applicator. The relationship between cross sections of upstream coating subzone 26 and downstream coating subzone 28 may vary due to the rheological properties of the coatings being processed and is achieved by the initial placement of the trough 16 containing the molded plastic member 18 beneath cylindrical applicator 10 through adjustment of the independent mountings of trough 16 (not shown). This is quite unlike the relationship of the cross section of the arcuate coating zone at the beginning of the upstream end of the upstream coating subzone and the cross section of the arcuate coating zone at the downstream end of the downstream coating subzone described in U.S. Pat. No. 4,738,879 where the cross sections and gaps are equal because the cylinder surface is parallel to the upstream liquid retaining surface and the downstream liquid retaining surface. The progressive narrowing of the arcuate coating zone of this invention in the downstream direction also progressively increases the pressure applied by the coating liquid material against the surface of the cylindrical applicator roll. This increased pressure also assists in displacing air trapped in the cells with coating liquid material from the arcuate coating zone. The total cross sectional area of the manifold should be large enough to provide a sufficient supply of coating material along the entire length of the cylindrical applicator to fill the coating zone between the upstream and downstream liquid retaining surfaces and the adjacent lower surface of the cylindrical applicator during rotation of the cylindrical applicator and to ensure that the coating material overflows the lip of the upstream liquid retaining surface, or the lip of the down stream liquid retaining surface, or both lips. For manifolds having a square cross section, the manifold may have, for example, a width of from about 1 to 5 cm, preferably from about 1.5 cm to about 2.5 cm, and a depth of from about 4 to about 6 times the trough-to-cylindrical applicator spacing measured from the liquid retaining surface at either side of the manifold. By continuously introducing fresh coating liquid into the manifold at a rate greater than the rate at which the coating liquid is applied to the web, the coating system of this invention ensures that fresh liquid coating material solution is available at all times thereby eliminating any increase in solution solids due to evaporation. The continuously replenished coating system of this invention also reduces the frequency of emptying, cleaning and filling of coating troughs and accommodates variations in coating parameters.

As indicated hereinbefore, the arcuate upstream liquid retaining surface and arcuate downstream liquid retaining surface of the elongated trough are closely spaced from the adjacent lower surface of the cylindrical applicator to provide an arcuate coating zone which progressively narrows in the downstream direction. The surface areas of the arcuate upstream liquid retaining surface and arcuate downstream liquid retaining surface should be sufficient to hold enough coating material to coat the entire length of the lower surface of the cylindrical applicator and to achieve overflow of the coating material over the upstream lip of the upstream liquid retaining surface, or over the downstream lip of the downstream liquid retaining surface, or simultaneously over both lips. This overflow may be recycled or removed from the coating system for disposal. Typically between about 100 degrees and about 160 degrees of arc of the lower surface of the cylindrical applicator is immersed in the liquid coating material during application of the coating to the web.

Any suitable cylindrical applicator may be utilized in the coating system of this invention. The cylindrical applicators preferably have a metallic outer surface for greater resistance to wear during extended coating operations. To minimize excess of wear of the coating cylindrical applicator, a chrome or other suitable hard metal layer may be applied over a base such as copper flashed steel. The cylindrical applicator may have a smooth surface or a patterned surface. For the application of low viscosity fluids, a patterned applicator is preferred for greater thickness control and wet film smoothness. For the purposes of the description of this invention, low viscosity fluids have a viscosity of less than about 1000 centipoises. Higher viscosity fluids may be difficult to employ with gravure applicators due to drying of the coating materials in the gravure applicator cells during the coating operation. The rate at which a coating solution is consumed depends to some extent on the cell pattern employed on the surface of the coating applicator. This is generally described in terms of the number of cells per square inch and the width of the etched portion of the cylindrical applicator. Typical cell patterns include pyramid and quadrangular cells. The cell walls are not perpendicular but are tapered to improve coating release. The type and size of the cell pattern partly determines the appearance of the coated surface and thickness. The proportion of cell width to wall thickness is for example about 2½:1 with typical cellular opening percentages ranging from about 20 percent to about 45 percent of the etched volume. Low viscosity solutions which are applied to form a dry film by gravure technique normally employ cell pattern sizes of between about 200 to about 400 lines per inch (about 4,000 to about 160,000 cells per square inch). Additionally, the cell depths generally range from about 0.0007 inch to about 0.002 inch depending upon the cell shape and size. Any suitable gravure pattern may be utilized. Typical gravure patterns include pyramid, quadrangular, trihelical, hexagonal, QCH-quad channel (available from Consolidated Engravers, Inc., Dallas, Tex. and North Carolina) and the like. Satisfactory results may be achieved when gravure applicator has a pattern having a volume range between about 1 cubic billion microns per inch squared and about 10 cubic billion microns per inch squared when employed with liquid coating mixtures having a viscosity between about 1 CPS and about 50 CPS and a surface speed of between about 5 feet per minute and about 200 feet per minute. However, speeds above and below this range may also be suitable. The close spatial relationship between the cylindrical applicator and adjacent trough surfaces produces a shearing action which when coupled with the progressive narrowing of the arcuate coating zone of this invention in the downstream direction helps maintain in suspension any particles dispersed in the coating materials and displace air bubbles entrained in the gravure cells with coating solution with homogeneous liquid coating material from the arcuate coating zone. However, some coating solutions or dispersions tend to settle during a long coating run if the applicator cylinder speed is not sufficient to provide adequate agitation to maintain the dispersion. If the applicator cylinder speed is not adequate to maintain the dispersion, additional solution or dispersion recirculation equipment may be employed to maintain homogeneity of the coating mixture. Excellent results have been achieved with a gravure applicator having a radius of about 5 inches, a QCH-quad channel pattern (400, available from Consolidated Engravers, Inc.,) having a cell volume of about 2.8 cubic billion microns per inch squared, and a gravure applicator surface speed about 150 feet per minute. The dimensions of the cylindrical applicator do not appear to be critical. Typical cylindrical applicator radii range from about 4 inches to about 8 inches. However, radii above and below this range may also be satisfactory. For example, excellent results have been achieved with a gravure cylinder applicator roll having a diameter of about 10 inches and a 360 QCH-Quad channel. The lines per inch (LPI) was about 360 QCH, the depth was about 0.0012 inch and the volume per square inch was about $5.8\times10^9$ cubic billion microns.

Any suitable means may be utilized to doctor the liquid coating mixture on the surface of the patterned applicator. Typical doctoring means include thin flexible metallic or non-metallic blades positioned in a trailing mode or in a reverse angle (doctoring) mode as well as other devices such as air knives. Generally, the blades or knives may be utilized in either the scrapping or wiping attitude. Typical metallic blades include stainless steel, high carbon steel, and the like. Typical non-metallic blade materials include polyurethane, neoprene, nylon, and the like. Composite blades of layers of metallic and non-metallic materials may also be utilized if desired.

The doctor blade is usually located between about the 10 o'clock and 10:30 o'clock position for optimum thickness control while avoiding premature drying through the evaporation of liquids from the coating mixture. Doctor blades positioned in the wiping attitude are preferred to minimize evaporation of the coating after doctoring but prior to contact with the web surface to be coated. A typical doctor blade angle for gravure applicators involve a contact angle of between about 55° and abut 65° through an imaginary plane tangent to the cylindrical applicator. Due to the attitude of the wiping blade, it can be positioned closer to the impression roll to minimize the area of the doctored surface exposed to evaporation prior to transfer of the coating material to the web surface. Since about 50 percent of the doctored film on the applicator roller is transferred to the web during transfer, the amount of evaporation of the coating components between the doctoring and transfer steps can significantly affect the thickness of the final coating on the web. The distance between the doctor blade and the impression roll nip with the specific cylindrical applicator is also selected to ensure that the solution during transfer is at a viscosity suitable for sufficient transfer of the coating material from the cylindrical applicator to the web.

After the surface of the cylindrical applicator is rotated out of the coating mixture in the trough, all the cells are filled and the excess solution is removed from the unetched areas of the cylindrical applicator by the doctor blade applied under pressure at a presetected angle to the applicator. If desired, the doctor blade may be oscillated by conventional means in a direction, for example, parallel to the axis of the cylindrical applicator. The pressure of the blade is dependent upon the viscosity and speed of the roll. For example, a coating system operating at about 1,000 feet per minute line speed and employing a coating mixture having a viscosity of about 30 to about 60 centipoises will utilize a blade pressure of about 40 pounds per linear inch of the cylindrical applicator. Lower viscosities utilize a lower pressure down to about 0.5 pounds per linear inch of the cylindrical applicator to minimize wear of the applicator caused by the reduced quantity of coating material which in turn reduces the lubrication of the applicator. Damaged applicators and/or doctor blades produce streaks on the finished product which is undesirable for precision products. The open design of the coater system of this invention readily allows visual observation by the operator of the surface of the cylindrical applicator prior to and after engagement with the doctor blade to determine whether the coating material is uniformly wetting the entire cylindrical applicator surface.

Contact pressure between the gravure applicator and the web to be coated is exerted by an impression roll. The transfer of solution from the cells on the cylindrical applicator to the web is by capillary attraction and impression pressure which creates a vacuum in the nip area where the web is brought into contact with the gravure applicator. The outer surface of the impression roll is general constructed of a compressible material which is inert to the solvents or vehicle used in the coating solution. Typical impression roll materials include elastomeric materials such as rubber, polyurethanes, and the like. For non-absorbent substrates, the hardness of the impression roll covering is between about 50 and about 65 shore "A". For non-absorbent substrates, the impression roll pres web and gravure roll is between about 20 pounds per linear inch and about 100 pounds per linear inch. Generally, the impression roll pressure coupled with the durometer hardness of the impression roll material are selected to cause less than about 0.050 inch penetration into the web material to avoid excessive stress from the impression roll and to minimize impression roll deterioration. The transfer of solution from the cells on the cylindrical applicator to the web is by capillary attraction and impression pressure. Generally, less than about 75 percent of the coating solution is transferred from the cylindrical applicator to the web. Other factors affecting transfer of the solution include the type of impression roll material and the web speed.

The viscosity of the coating solution is preferably maintained between about 1 centipoises and about 1000 centipoises. In some cases, the viscosity of the coating solution is controlled within a very narrow range. Too high a viscosity solution in the coating trough prevents the solution from filling the cells properly and leads to incomplete coating or coating thickness variations. Solutions which have too low a viscosity also may lead to poor coatings when employing deeper cell patterns. The solution tends to leave the cells too quickly causing striations of light and dark patterns on the substrate referred to as mottling or reticulation. The appropriate viscosity for a given gravure coating system is affected by factors such as the characteristics of the applicator roll surface including shape of any cells, the range of depth of the cells, the speed of the coating line, the solvent evaporation rate, the doctor blade distance to the point of impression and the absorbency of the substrate for the coating solution. A typical range for percent solids in the coating solution is from about 1 percent by weight to about 3 percent by weight based on the total weight of the solution. In a typical process of this invention, the coating solution has a surface tension of about 31.2 dynes per centimeter, a viscosity of about 5 centipoises (0.05 dynes sec/$cm^2$) and a solid content of about 1 percent.

Any suitable web may be coated with the coating system of this invention. Typical web materials include metal, organic polymers, composite materials and the like. Typical organic polymers include polyesters, polycarbonates, polyamides, composite materials and the like. Typical composite materials include coated or laminated webs such as plastic webs coated with a different plastic or coated with vapor deposited metals. Generally, the webs are flexible, thin, and have a substantially uniform thickness.

In a typical process of this invention, a coating system similar to that illustrated in FIG. 1 was employed comprising an ultrahigh molecular weight polyethylene elongated trough having a length of about 50 inches and an arcuate coating material retaining surface width of about 18 inches. The cylindrical applicator was chrome plated; had a length of about 47 inches and a radius of about 5 inches; and the outer surface carried a QCH-quad channel pattern (400, available from Consolidated Engravers, Inc.,) having a cell volume of about 2.8 cubic billion microns per inch squared. Each end of the elongated trough contained parallel drain channels having a semicircular cross section and a radius of about 6 mm. The spacing between the surface of the applicator cylinder and the adjacent upstream liquid retaining surface at about the 9 o'clock position relative to the cylinder was about 20 mm and the spacing between the surface of the applicator cylinder and the adjacent downstream liquid retaining surface at about the 3 o'clock position relative to the cylinder was about 20 mm. The coating mixture had a viscosity of about 5 centipoises, a surface tension of about 31.2 dynes per centimeter, and comprised about 1 percent by weight polyester film forming resin dissolved in an organic solvent. This coating mixture was fed into the elongated trough from a pressure pot, by means of a metering pump, conduits and hoses. The coating solution was fed to the trough by means of a closed metering system which continuously supplied fresh coating material to a manifold located along the bottom of the elongated trough through a suitable inlet fitting. The coating material was distributed along the length of the trough via the manifold. As the liquid level in the elongated trough rose, it wetted the lower surface of the cylindrical applicator evenly. The cylindrical applicator was rotated at a surface speed of about 150 feet per minute. As the cylindrical applicator rotated in the trough, the coating mixture entered the cells. After the surface of the cylinder rotated out of the coating mixture in the trough, the excess solution was removed from the unetched areas of the cylindrical applicator by a slowly reciprocating stainless steel doctor blade applied under pressure of about 20 pounds per linear inch of the cylindrical applicator. The doctor blade, in a trailing mode, was located at about the 10:15 o'clock position relative to the cylinder. The blade contact angle was about 60° through an imaginary plane tangent to the cylindrical applicator. The coating material removed by the doctor blade fell back toward the elongated trough. Rotation of the cylindrical applicator also caused coating material on the surface of the cylindrical applicator to rise higher on the downstream end of the arcuate coating zone relative to the beginning of the upstream side of the arcuate coating zone. Excess coating material was applied to the cylindrical applicator to further ensure that all the cells on the surface of the applicator roll were filled. The beginning of the upstream side of the arcuate coating zone, i.e. the upstream lip of the elongated trough, was low enough to allow the liquid coating material to overflow into a drain pipe leading to a collecting vessel for waste. Sufficient fresh coating material was continuously supplied to the manifold at the bottom of the trough by the metering system to cause a slight amount of coating material to overflow the upstream lip of the elongated trough. An impression roll, located at the 12 o'clock position of the cylindrical applicator, applied a pressure of about 50 pounds per linear inch on a polyester web being coated and the cylindrical applicator. The impression roll comprised a steel cylindrical core coated with polyurethane and had an outside diameter of about 5 inches. The deposited thickness of the uniform coating on the web surface after drying was about 0.05 micrometer. The coating system of this invention as described above may be run continuously without any down time for shutdown for cleaning or changing solutions. After trial runs of about 6 hours, the resulting applied coatings were examined for deletions and voids in the applied coating When the process described above was repeated except that a 35 mm spacing between the surface of the applicator cylinder and the adjacent upstream liquid retaining surface at about the 9 o'clock position relative to the cylinder and with a 5 mm spacing between the surface of the applicator cylinder and the adjacent downstream liquid retaining surface at about the 3 o'clock position relative to the cylinder to was used to form an arcuate coating zone in which the the lower surface of the applicator cylinder was adjacent to and parallel with the upstream and downstream liquid retaining surfaces. After trial runs of about 6 hours, the resulting applied coatings were examined for voids and deletions in the applied coating. A comparison of the defects observed in the applied coating using the progressive narrowing arcuate coating zone in the downstream direction of this invention with the defects observed in the applied coating fabricated with an arcuate coating zone in which the the lower surface of the applicator cylinder was adjacent to and parallel with the upstream and downstream liquid retaining surfaces revealed that the coating system of this invention had 80 percent fewer defects of all descriptions.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for applying a coating to a moving web comprising providing an elongated trough, rotating a cylindrical applicator about its axis in contact with coating liquid having a viscosity of between about 1 centipoise and about 1,000 centipoises within said trough, said rotating being in a direction from upstream to downstream, said applicator having an upper surface and a lower surface, said cylindrical applicator being below and in contact with said web to carry coating liquid from said trough to said web, said trough having an arcuate upstream liquid retaining surface and an arcuate downstream liquid retaining surface substantially parallel to and spaced from the lower surface of said cylindrical applicator to define an arcuate coating zone which progressively narrows in the downstream direction, said arcuate upstream liquid retaining surface and said arcuate downstream liquid retaining surface being separated by a manifold extending substantially parallel to the axis of said cylindrical applicator, said arcuate downstream liquid retaining surface and said arcuate upstream liquid retaining surface extending from said manifold upwardly a sufficient distance along the periphery of said cylindrical applicator to retain most of said liquid in said coating zone, said arcuate downstream liquid retaining surface extending upwardly a greater distance than said arcuate upstream liquid retaining surface to compensate for a pumping action due to rotation of said cylindrical applicator spaced from said arcuate downstream liquid retaining surface, continuously supplying sufficient coating liquid to said arcuate applicator coating zone whereby said coating liquid coats the entire length of the lower surface of said cylindrical applicator and overflows out of the arcuate coating zone, and continuously introducing fresh coating liquid into said manifold at a rate greater than the rate at which said coating liquid is applied to said web.

2. A process for applying a coating to a moving web according to claim 1 wherein said coating liquid overflows out of the upstream end of said arcuate coating zone.

3. A process for applying a coating to a moving web according to claim 1 including maintaining a higher pressure in said coating liquid in said arcuate coating zone adjacent said downstream liquid retaining surface than in said coating liquid in said arcuate coating zone adjacent said upstream liquid retaining surface.

4. A process for applying a coating to a moving web according to claim 1 including maintaining between about 100 degrees and about 160 degrees of arc of the lower surface of said cylindrical applicator immersed in said liquid coating material during application of said coating liquid to said web.

5. A process for applying a coating to a moving web according to claim 1 wherein radial distances between said arcuate upstream liquid retaining surface and said surface of said cylindrical applicator decreases in a downstream direction; radial distances between said arcuate downstream liquid retaining surface and said surface of said cylindrical applicator decreases in a downstream direction; and said radial distances between said arcuate upstream liquid retaining surface and said surface of said cylindrical applicator is greater than said radial distances between said arcuate downstream liquid retaining surface and said surface of said cylindrical applicator.

6. A process for applying a coating to a moving web according to claim 1 wherein a radial distance between said arcuate upstream liquid retaining surface and said surface of said cylindrical applicator at about the 9 o'clock position is between about 150 percent and about 500 percent greater than said radial distance between said arcuate downstream liquid retaining surface and said surface of said cylindrical applicator at about the 3 o'clock position when viewing an end of said cylindrical applicator which rotates clockwise.

7. Apparatus for coating webs comprising a rigid, elongated trough, a cylindrical applicator mounted for rotation about its axis within said trough, said rotation being in a direction from upstream to downstream, said applicator having an upper surface and a lower surface, said trough having an arcuate upstream liquid retaining surface and an arcuate downstream liquid retaining surface spaced from the lower surface of said cylindrical applicator to define an arcuate coating zone which progressively narrows in the downstream direction, a manifold between said upstream liquid retaining surface and said downstream liquid retaining surface, said manifold extending substantially parallel to the axis of said cylindrical applicator, said arcuate downstream liquid retaining surface and said arcuate upstream liquid retaining surface extending from said manifold upwardly a sufficient distance along the periphery of said cylindrical applicator to retain most of any liquid in said applicator coating zone, said arcuate downstream liquid retaining surface extending upwardly a greater distance than said arcuate upstream liquid retaining surface to compensate for a pumping action due to rotation of said cylindrical applicator spaced from said arcuate downstream liquid retaining surface, a wall at each end of said trough to retain said liquid in said arcuate coating zone, each of said walls being spaced from the adjacent end of said cylindrical applicator, at least one of said liquid retaining surfaces having an overflow lip at an upper end for overflow of liquid from said arcuate coating zone, and means for continuously introducing liquid into said manifold.

8. Apparatus for coating webs according to claim 7 wherein said overflow lip is located at the upper end of said upstream liquid retaining surface.

9. Apparatus for coating webs according to claim 7 wherein radial distances between said arcuate upstream liquid retaining surface and said lower surface of said cylindrical applicator decreases in a downstream direction; radial distances between said arcuate downstream liquid retaining surface and said lower surface of said cylindrical applicator decreases in a downstream direction; and said radial distances between said arcuate upstream liquid retaining surface and said lower surface of said cylindrical applicator is greater than said radial distances between said arcuate downstream liquid retaining surface and said lower surface of said cylindrical applicator.

10. Apparatus for coating webs according to claim 7 wherein a radial distance between said arcuate upstream liquid retaining surface and said surface of said cylindrical applicator at about the 9 o'clock position is between about 150 percent and about 500 percent greater than a radial distance between said arcuate downstream liquid retaining surface and said surface of said cylindrical applicator at about the 3 o'clock position when viewing an end of said cylindrical applicator which rotates clockwise.

11. Apparatus for coating webs according to claim 7 including a doctor blade in contact with said cylindrical applicator above and spaced from the downstream end of said arcuate downstream liquid retaining surface.

12. Apparatus for coating webs according to claim 11 wherein said doctor blade in contact with said cylindrical applicator above and spaced from the downstream end of said arcuate downstream liquid retaining surface at between about the 10:00 o'clock and 10:30 o'clock position or at between about the 2:00 o'clock and 2:30 o'clock position when viewing an end of said cylindrical applicator which rotates clockwise.

13. Apparatus for coating webs according to claim 11 wherein said doctor blade is in wiping contact with said cylindrical applicator.

14. Apparatus for coating webs according to claim 11 wherein said the contact angle of said doctor blade with said cylindrical applicator is between about 55° and about 65° through an imaginary plane tangent to said cylindrical applicator at a point where said blade contacts said applicator.

15. Apparatus for coating webs according to claim 7 including an impression roll adjacent to the upper surface of said cylindrical applicator, said impression roll having an axis substantially parallel to the axis of cylindrical applicator.

16. Apparatus for coating webs according to claim 7 wherein said cylindrical applicator is a gravure applicator.

17. Apparatus for coating webs according to claim 16 wherein said cylindrical applicator has gravure pattern having a value range between about 1 billion cubic microns per inch squared and about 10 billion cubic microns per inch squared.

18. Apparatus for coating webs according to claim 7 wherein said elongated trough has a Rockwell R hardness less than the Rockwell R hardness of said cylindrical applicator.

* * * * *